US006459802B1

(12) United States Patent
Young

(10) Patent No.: US 6,459,802 B1
(45) Date of Patent: Oct. 1, 2002

(54) MICROPHONE SHOCK MOUNT SYSTEM

(76) Inventor: Garrit A. R. Young, 6067 N. Jack Tone Rd., Stockton, CA (US) 95215

( * ) Notice: Subject to any disclaimer, the term of this patent is extended or adjusted under 35 U.S.C. 154(b) by 20 days.

(21) Appl. No.: 09/607,979

(22) Filed: Jun. 30, 2000

(51) Int. Cl.[7] ..... H04R 25/00

(52) U.S. Cl. ..... 381/368; 381/361; 381/363; 381/366

(58) Field of Search ..... 381/355, 356, 381/361, 362, 363, 366, 368, FOR 147, FOR 148; 211/60.1, 66; 248/60, 317, 604, 610

(56) References Cited

U.S. PATENT DOCUMENTS

| | | | | | |
|---|---|---|---|---|---|
| 4,194,096 | A | * | 3/1980 | Ramsey | 381/366 |
| 4,396,807 | A | * | 8/1983 | Brewer | 381/366 |
| 4,514,598 | A | * | 4/1985 | Plice | 381/368 |
| 4,546,950 | A | * | 10/1985 | Cech | 381/368 |

* cited by examiner

*Primary Examiner*—Curtis Kuntz
*Assistant Examiner*—Suhan Ni

(74) *Attorney, Agent, or Firm*—J. E. McTaggart

(57) ABSTRACT

A microphone shock-mount system utilizes an outer tubular shell having a diameter substantially greater than that of a typical microphone and having a length shorter than that of a typical microphone. The shell is attached to a microphone45
stand adaptor of a swivel type commonly utilized for attachment to the shaft of a stand or boom, and is configured with a pattern of through-holes into which round stretch-cord is laced to establish several runs extending across internally under tension, typically four runs: a pair at the front and a second pair at the rear of the shell. The stretch-cord runs are configured in a special offset pattern such that a typical microphone with cable attached can be mounted and retained in a concentric location within the shell by inserting the free end of the microphone to spread and engage the central region of each opposed pair of stretch-cord runs. For holding a small-sized region of a microphone, the center region of adjacent runs may be deflected inwardly in a manner to cris-cross each other, forming a double-X pattern that stretches the cord to greater tension, wraps further around the microphone and retains it more securely. The microphone shock-mount system of the present invention features simple construction, convenient installation and removal of a microphone, secure support and resilient cushioning for isolation against mechanical shock.

5 Claims, 4 Drawing Sheets

MICROPHONE SHOCK MOUNT SYSTEM

FIELD OF THE INVENTION

The present invention relates to the field of audio/acoustic technology and more particularly it relates to a system for shock-mounting a microphone that is to be deployed at the end of a boom or on a stand.

BACKGROUND OF THE INVENTION

Microphones are usually made with some degree of internal shock mounting, often with the assumption that they may be hand-held. Where a microphone is attached solidly to a boom or stand, further shock-mounting may still be required to isolate against unwanted environmental noise conducted through the mounting, e.g. floor or other building structure vibration from heavy vehicles operating nearby, or direct impacts to the boom or stand

DISCUSSION OF RELATED KNOWN ART

U.S. Pat. No. 4,194,096 to Ramsey discloses a MICROPHONE SHOCK MOUNT AND ASSEMBLY utilizing a pair of flat closed bands of elastomer material at each end of the assembly extending transversely around lower and upper frames of the assembly which are hinged together along one side to receive the microphone.

U.S. Pat. No. 4,514,598 to Plice discloses a MICROPHONE SHOCK-MOUNTING APPARATUS comprising a cradle that flexes when opening to receive the microphone then closes around the microphone body to hold it in place.

OBJECTS OF THE INVENTION

It is a primary object of the present invention to provide a microphone shock-mounting system of simple structure to isolate a stand- or boom-mounted microphone from noise that would otherwise be transmitted by the rigidly attached stand or boom.

It is a further object that a microphone suitable for handheld operation can be very easily mounted to and removed from the shock-mounting system without disconnecting the microphone cable.

It is a further object to make the shock mount system easy to manufacture from readily available materials, and to include hardware for attachment to conventional microphone stands and booms.

SUMMARY OF THE INVENTION

The aforementioned objects have been met by the invention of a microphone shock-mount system in which the main element is an outer tubular shell substantially greater in diameter and shorter in length than a typical microphone. The tubular shell is fitted externally with a swivel adaptor for attachment to a regular microphone boom or stand, and internally with several runs of readily available stretch-cord extending diametrically across the tubular shell member in a special offset configuration that accommodates microphones of various sizes and shapes.

A typical microphone with cable attached can be retained in a concentric location within the tubular member by inserting the free end of the microphone to engage opposed pairs of the stretch-cord runs. For a larger microphone or a larger portion of a microphone the stretch-cord runs are simply deflected near their center region to spread apart as required to accept the microphone. For a small diameter microphone or portion thereof, at least one adjacent pair of stretch-cord runs are deflected in their central region in a manner to cris-cross each other, forming a double-X pattern that stretches the elastic cord and retains the microphone securely.

The microphone shock-mount system of the present invention features convenient installation and removal of a microphone and provides resilient cushioning for isolation against stock, while supporting the microphone securely.

BRIEF DESCRIPTION OF THE DRAWINGS

The above and further objects, features and advantages of the present invention will be more fully understood from the following description taken with the accompanying drawings in which:

FIG. 2 is a front elevation view of the microphone shock mount of

FIG. 1 showing the location of the front pair of stretch cords.

DETAILED DESCRIPTION

Figure 1:
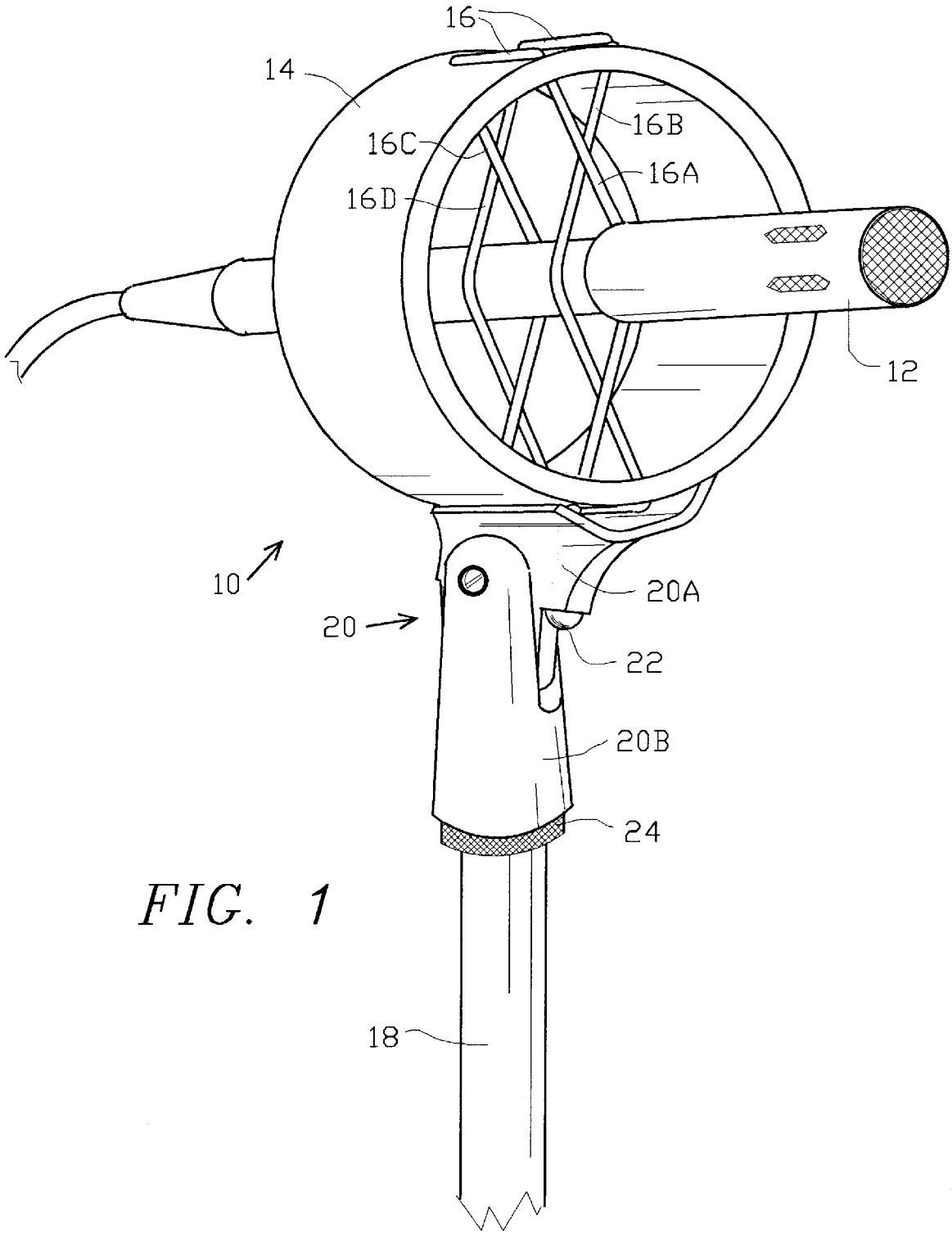
FIG. 1 is a perspective view showing a microphone shock-mount of the present invention deployed on an extension shaft of a microphone stand, holding a microphone in shock-mounted manner.

FIG. 1 is a perspective view showing a microphone shock-mount 10 illustrating a preferred embodiment of the present, invention. Microphone 12 is suspended resiliently within a tubular surround shell 14 by a stretched round elastic cord 16. Shell 14 is mounted to an extension shaft 18 of a microphone stand or boom via a swivel microphone stand adaptor 20 having an upper channel flange portion 20A attached to shell 14 by a bolt 22 and a lower portion threadedly attached to shaft 18, locked in place by a knurled lock nut 24.

This particular horizontal orientation for microphone 12 and vertical direction for shaft 18 is arbitrary and shown only as a basic example. As a boom or boom extension, shaft 18 could run in virtually any direction, and the orientation of microphone 16 would depend on its directivity and the location of the sound source. Some elongate microphones are intended to be operated in a vertical orientation: the purpose of swivel adaptor is to provide a wide range of adjustment to accommodate such variations.

Elastic cord 16 is laced through holes provided in shell 14 so that inside, the cord 16 traverses shell 14 in four substantially diametric cord runs: 16A–16D, Each pair of cord runs 16A,B and 16C,D is crisscrossed in two places as shown to suspend microphone 12 in a resilient shock-mounted manner that isolates microphone 12 from noise and/or vibrations picked up from the floor and from other disturbances that could reach shaft 18, e.g. via the microphone stand or boom.

Figure 2:
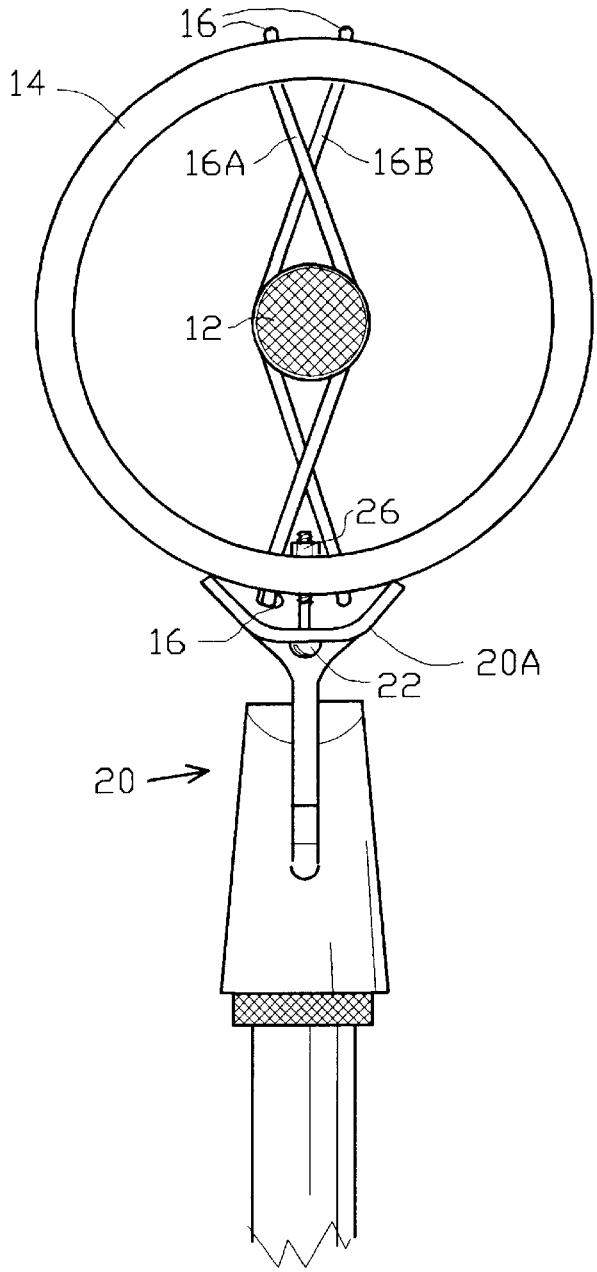

FIG. 2 is a front elevation view of the microphone shock mount 10 showing the location of the front pair of stretch cords. 16A and 16B cris-crossed as shown to support microphone 12 in a central axis region of shell 14. For microphones or portions thereof having relatively small diameter, cri-crossing each pair of cord runs in this manner retains the microphone 12 centered in place more accurately and securely than if the pairs were merely co-located at their ends such that they could not be cris-crossed in the manner shown. Much larger microphones or microphone portions may be supported without cris-crossing the stretch-cords.

Figure 5:
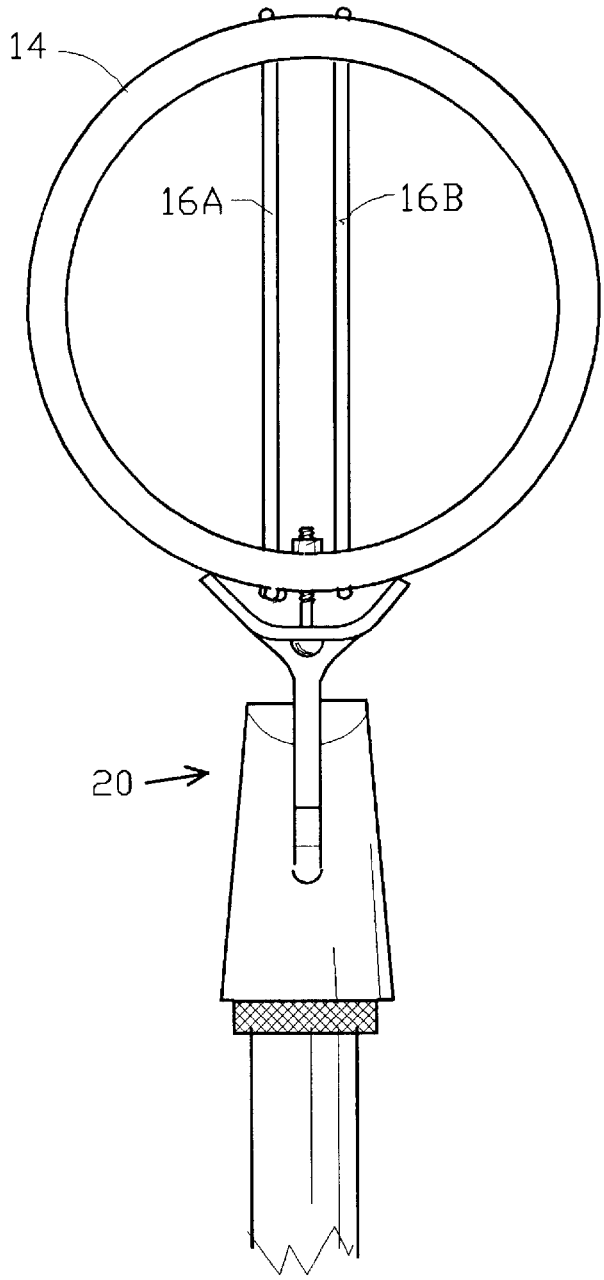
FIG. 5 is a front view of the microphone shock mount of FIG. 2 but with the microphone removed.

The elastic cord 18 is laced through eight holes drilled in shell 16 that are located in a manner that provides four parallel runs: a pair near each end of shell 16 running substantially diametrically across in the absence of a microphone (see FIG. 5).

The upper portion 20A of swivel adaptor 20 is attached to shell 14 by a machine bolt 22 engaging a nut 26 located inside the shell 14 at the bottom region.

Figure 3:
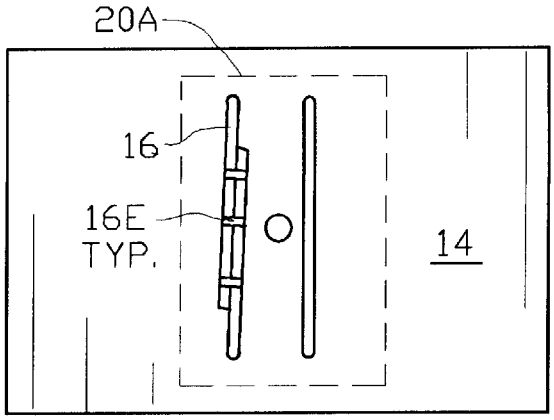
FIG. 3 is a bottom view of the tubular surround shell of the microphone shock mount of FIG. 2.

FIG. 3 is a bottom view of the shell 14 with the adapter 20 removed; the location of the upper portion of the swivel adaptor is shown in the dashed outline 20A.

The two ends of elastic cord 16 are shown seized together by three fasteners 16E which may be crimped metal clips or equivalent. Alternatively the two ends of cord 16 could be tied together, or seized together in some other manner. The fastened ends become substantially concealed by the upper portion 20A of swivel adaptor 20.

Figure 4:
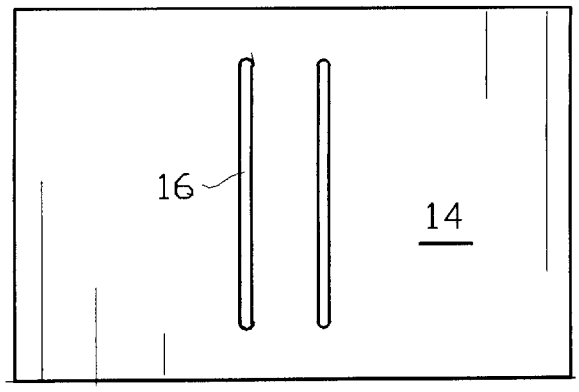
FIG. 4 is a top view of the microphone shock mount of FIG. 2.

FIG. 4 is a top view of the shell 14 of FIGS. 2 and 5, showing the two parallel transverse runs of elastic cord 16 on the top surface, each laced through holes provided in shell 14.

FIG. 5 depicts the subject matter of FIG. 2 but with the microphone removed, showing the two parallel vertical cord runs 16A and 16B spanning the diameter of shell 14 vertically. The total cord length is made such that under this condition the cord runs are only slightly stretched and thus are under relatively weak tension.

Figure 6:
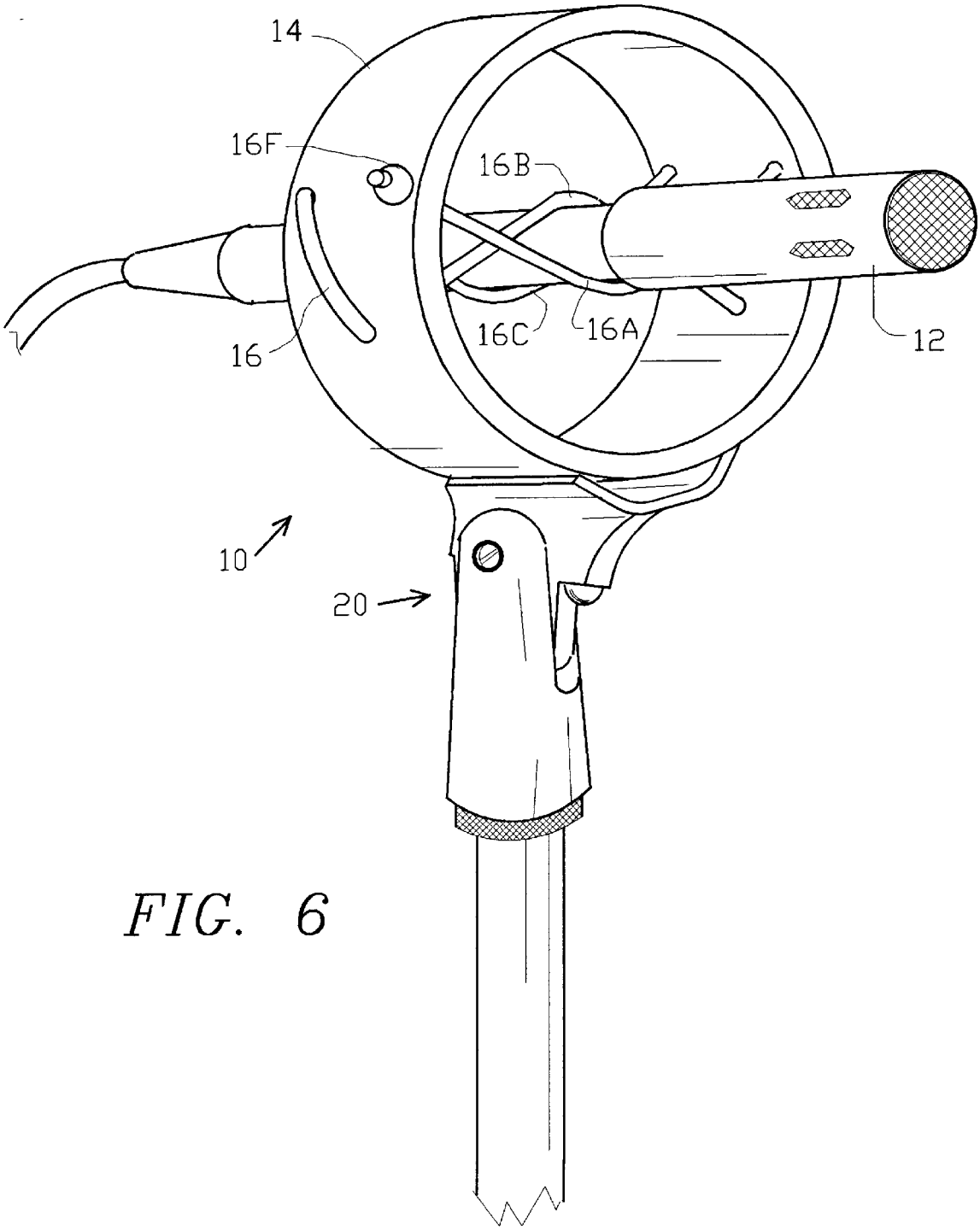
FIG. 6 is a perspective view of an alternative embodiment of the invention.

FIG. 6 is a perspective view depicting an alternative embodiment of the invention utilizing only a total of three stretch cord runs: 16A, 16B and 16C arranged in a staggered pattern and stretched horizontally across shell 14, laced through holes in shell 14 as shown and secured at each by a retaining ring 16F, or a functionally equivalent stop knot.

When the microphone 12 is installed as shown, the elastic cord runs are alternately opposed and form the double-X pattern of the present invention as described above; runs 16A and 16B are adjacent and opposed, similarly runs 16B and 16C are adjacent and opposed. The deployment of two end runs (16A and 16C) under the microphone 12 with the single central run (16C) on the top compensates for the weight of the microphone 12 by providing double tension on the underside. As with the previously described embodiment, larger microphones can be accommodated and supported by simply inserting the microphone by deflecting the stretch-cords apart rather than to the cris-crossed condition.

The shell 14, in the embodiments shown, is made from a 2 ⅜ inch length of molded plastic tubing such as ABS or PVC with 3.5 inches outside diameter and 3 inches inside diameter, making the shell thickness 0.25". The elastic cord 16 is a commercially available round "bungee" type cord about 3/16 inch diameter with a woven fabric jacket: it is dimensioned to provide a moderate tension in the condition shown in FIG. 5 so that the increased tension caused by stretching cord 16 to insert a microphone 12 as shown in FIG. 2 is made sufficient to adequately support the microphone 12, and yet to be easily installed and removed.

Mounting adaptor 20 can be made from commercially available microphone hardware with minimal modification required only in the upper portion.

As an alternative to utilizing a single total length piece of stretch cord 16 to form the four cord runs, these may be formed from individual single lengths of cord, and may be anchored by a knot or other constraint affixed at each end of each run to bear against the outside surface of shell 14, the length being dimensioned to set up the desired tension.

As an alternative to making the cord 16 bear against the outer surface of shell 14, the runs could be end-attached to, or laced through eyes or equivalent fastenings suitably located around the inner surface of the shell 14.

As an alternative to the orthogonal directions of the elastic cord runs shown in FIGS. 1, 2 and 5 and in FIG. 6, the invention can be practiced with pairs of cords directed at any other designated angle or angles. The two pairs of elastic cord runs do not need to be parallel to each other as shown: each pair could be directed to any designated angle independent of the other pair.

The invention can be made and practiced utilizing any of numerous suitable metal or plastic materials for the structural parts such as shell 14 and mounting adaptor 20, and could be made and practiced in various forms, shapes, sizes other than those shown and described as illustrative embodiments.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A shock mount system for resiliently supporting a microphone comprising:

a tubular shell having a central axis, an inside diameter substantially greater than that of a typical microphone and a predetermined length along the central axis, substantially less than length of a typical microphone;

fastening means for attaching said shell to a shaft of a conventional microphone stand; and at least three elastic cord runs disposed within said shell, each said cord run made and arranged to stretch with a predetermined undeployed tension substantially diametrically across said shell orthogonal to the axis disposed at a predetermined offset distance from the axis and arranged in a pattern such that, in deployment, a microphone inserted generally along the axis amongst said cord runs becomes fully supported therefrom due to deflection in a central region of the cord run, causing further stretching thereof with tension increased beyond the undeployed tension, each adjacent pair of said cord runs engaging the microphone in one of two modes having opposite directions of cord deflection: a first mode, for relatively large microphone regions, wherein-the cord deflection is outwardly, spreading the adjacent pair apart, and a second mode, for relatively small microphone regions, wherein the cord deflection is inwardly, extending across the central axis and sufficiently beyond, such that deployment causes two crossings of the adjacent pair of cord runs, one crossing on each opposite side of the microphone.

2. The shock mount system as defined in claim 1 comprising:

a first pair of said elastic cord runs that, in absence of a supported microphone, are made to be substantially parallel to each other and disposed symmetrically offset from the central axis near a first end of said shell;

a second pair of said elastic cord runs that, in absence of a supported microphone, are made substantially parallel to each other and disposed symmetrically offset from the central axis near a second end of said shell opposite the first end.

3. The shock mount as defined in claim 2 wherein said shell is configured with two sets of four through-holes each set arranged in a rectangular pattern at diametrically opposite regions of said shell, said first and second elastic cord runs being implemented by a single length of elastic cord, having two ends, laced through the through-holes in said shell, the ends being affixed together so as to have a predetermined overall length that acts to establish the undeployed tension in said cord runs.

4. The shock mount as defined in claim 3 wherein said fastening means comprises a swivel microphone stand adaptor having a channel flange portion attached to said shell in the region of one of the rectangular patterns of four through-holes, made and arranged to enclose and substantially conceal the elastic cord in that region external to the shell.

5. The shock mount as defined in claim 4 wherein the affixed-together ends of the single length of elastic cord are arranged to be enclosed and substantially concealed by the channel flange of said microphone stand adaptor.

* * * * *